United States Patent [19]

Feibelman

[11] 4,175,660

[45] Nov. 27, 1979

[54] DISPLAY PACKAGE FOR JEWELRY AND THE LIKE

[75] Inventor: Jeffrey A. Feibelman, Cranston, R.I.

[73] Assignee: A & H Mfg. Co., Cranston, R.I.

[21] Appl. No.: 930,519

[22] Filed: Aug. 3, 1978

Related U.S. Application Data

[63] Continuation-in-part of Ser. No. 810,366, Jun. 27, 1977, abandoned.

[51] Int. Cl.[2] ..... B65D 73/00

[52] U.S. Cl. ..... 206/468; 206/461

[58] Field of Search ..... 206/461, 462, 464, 465, 206/467, 468, 566, 44.12, 45.14, 45.15

[56] References Cited

U.S. PATENT DOCUMENTS

| | | | |
|---|---|---|---|
| 3,162,309 | 12/1964 | Kimbrough | 206/468 |
| 3,414,159 | 12/1968 | Murr | 206/465 X |
| 3,530,978 | 9/1970 | Lewandowski | 206/468 |
| 4,016,972 | 4/1977 | Szamborski | 206/566 X |
| 4,043,450 | 8/1977 | Rielly | 206/566 X |

*Primary Examiner*—Donald F. Norton

*Attorney, Agent, or Firm*—Salter & Michaelson

[57] ABSTRACT

A display package for jewelry and the like comprising a first panel adapted to be suspended from a support, said first panel having a pair of rearwardly extending flanges adapted to removably receive a second panel having at least a pair of end walls, whereby when said first and second panels are assembled, they cooperate to define an enclosure located at the rear of said first panel, said enclosure being adapted to receive at least a portion of the jewelry article being displayed.

9 Claims, 18 Drawing Figures

DISPLAY PACKAGE FOR JEWELRY AND THE LIKE

BACKGROUND AND SUMMARY OF THE INVENTION

This application is a continuation-in-part of application Ser. No. 810,366 filed June 27, 1977, now abandoned.

This invention relates to a display device and particularly to a device adapted to display jewelry articles such as necklaces, earrings, brooches, and the like wherein an ornament is provided with means for mounting same on the body or apparel of the wearer. A common way of supporting such items is to place them on a card whereby the ornament is on the front surface of the card and the mounting means extends through the card and is positioned at the rear thereof. This is a particular problem with necklaces and the like where the chain is usually gathered within a small envelope attached to the back of the card so as to be stored and hidden from view. Displays of this type also usually include means for permitting a plurality of such devices to be mounted upon a rack or counter display so that such may be readily viewed by prospective customers.

It may be apparent from the above description that it would be desirable to present some means by which the excess length of chain could be better and more conveniently stored and which device may additionally serve simultaneously as a carrying as well as display container for the jewelry articles. It is also desirable that immediate and convenient access to the article displayed and in part stored by the display device be permitted so that the article may be more closely examined, i.e. trial worn for size and appeal.

Accordingly, it is an object of the present invention to provide a display device wherein the ornamental portion of a jewelry article such as a necklace may be suspended for viewing and which simultaneously serves as a container for the remaining chain portions of such article.

Another object is the provision of a display device that is also applicable for use in connection with other articles of jewelry, such as brooches and earrings, specifically including magnetic earrings.

Another object of the present invention is to provide a display device of the immediately aforementioned type in which the component portions thereof may be individually fabricated inexpensively as by extrusion techniques and then interfitted to form a composite combination container and display device of extremely low cost.

A still further object of the present invention is the provision of a display device which permits ready access of the jewelry article displayed therein and which simultaneously may be utilized as an after-purchase container.

These and other objects of the present invention are accomplished by a device having a first panel in turn having means for suspending the device from a display rack or the like and further including a pair of transversely extending walls or flanges longitudinally spaced from each other and outwardly extending therefrom between which a second panel spaced from said first panel is received. The second panel includes a pair of longitudinally orientated outwardly extending flanges or walls at opposite ends thereof, which flanges are adapted to contact the first panel at locations adjacent opposite sides thereof in such a manner that the panels, the flanges and the walls cooperatively form a container for receipt of at least portions of the jewelry article being displayed and the entire jewelry article when utilized as a container.

Other objects, features and advantages of the invention shall become apparent as the description thereof proceeds when considered in connection with the accompanying illustrative drawing.

DESCRIPTION OF THE DRAWINGS

In the drawings which illustrate the best mode presently contemplated for carrying out the present invention.

DESCRIPTION OF THE INVENTION

Figure 1:
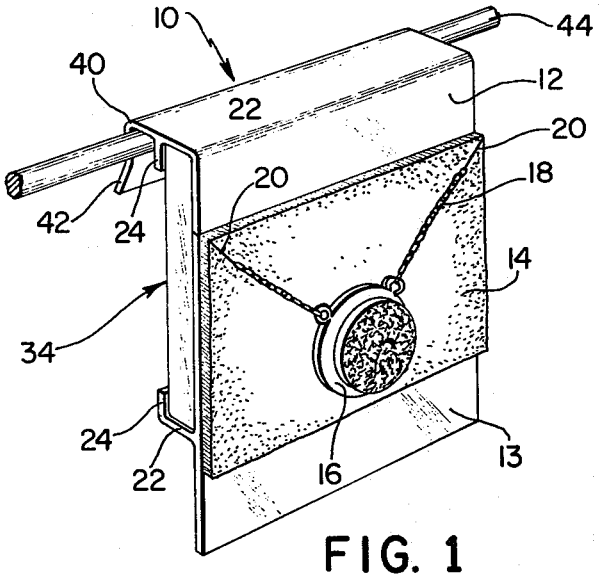
FIG. 1 is a perspective view showing one form of the display device of the present invention.
Figure 2:
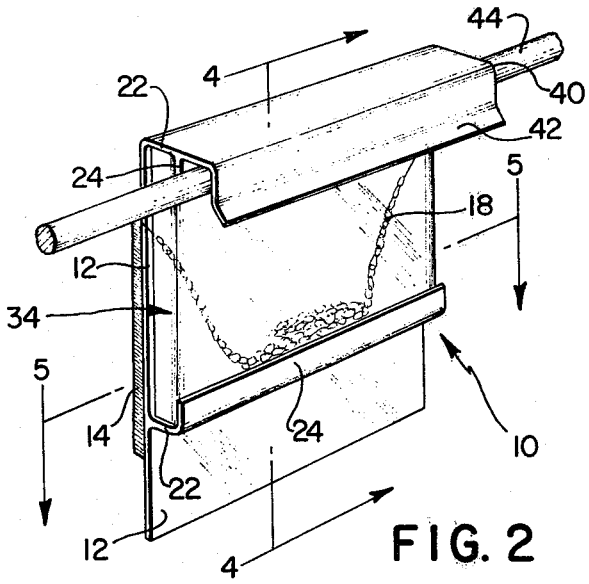
FIG. 2 is a rear perspective view of the device shown in FIG. 1.
Figure 4:
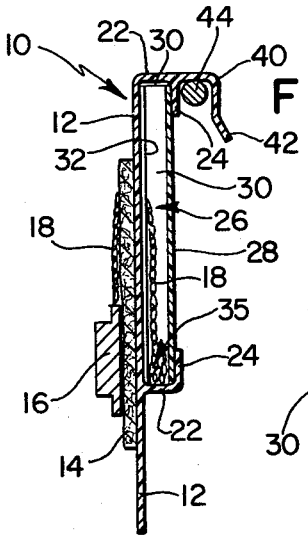
FIG. 4 is a side sectional view taken along the line 4—4 of FIG. 2.
Figure 5:
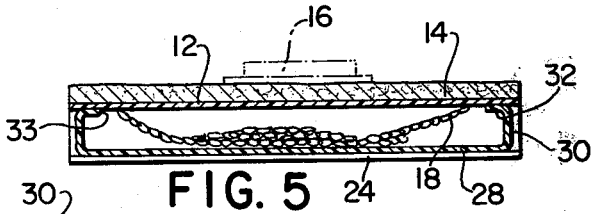
FIG. 5 is a top sectional view taken along the line 5—5 of FIG. 2.
Figure 3:
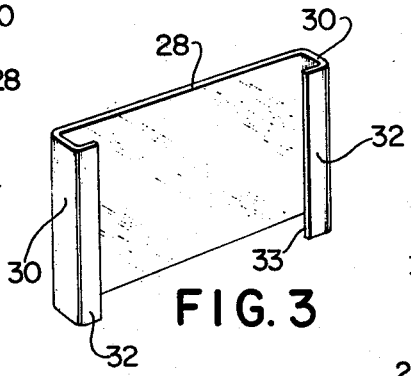
FIG. 3 is a perspective view of the second panel utilized in conjunction with the device shown in FIGS. 1 and 2.

Turning now to the drawing and particularly FIGS. 1–6 thereof, one embodiment of the display device 10 of the present invention is shown. Such includes a generally planar first panel 12 provided at its front surface thereof with a pad 14 having a flocked or otherwise decorative surface upon which the ornamental portion 16 of a jewelry article, including a chain 18, is adapted to be suspended, as from a pair of diagonally inwardly directed slits 20 disposed both through the pad 14 and the first panel 12. Such slots 18 frictionally grasp portions of the chain so that the ornament 16 may be attractively displayed in a generally centrally disposed position with respect to the first panel 12.

The first panel 12 further includes a pair of transversely extending vertically spaced flanges or walls 22 rearwardly extending therefrom. The walls in turn are provided with longitudinal inwardly directed lips 24 which, in effect, form a channel 26 at the rear of the first panel 12. Such channel 26 is adapted to receive a second panel 28 generally of planar configuration and further including a pair of flanges or walls 30 forwardly extending at each side edge thereof and terminating in an inwardly bent secondary lip or extension 32. The second panel 28 is adapted for receipt in the channel 26 in such position that the secondary lips or extensions 32 engage rear portions of the first panel 12 in such a manner that the first and second panels cooperatively form a fully enclosed container 34 for receipt of excess portions of chain 18 disposed behind the first panel 12. It should be clear from simultaneous reference to FIGS. 1–7 that the panels 12 and 28 respectively form the front and rear surfaces of such container, the walls 22 form the upper and lower portions thereof, and the flanges 30 form the edge portions thereof. Also, it should be brought out that the second panel 28 is permitted to move slidably transversely of the entire display device 10 at least to the extent permitted by the edges 33 of the extensions 32 prior to their contact with portions of the chain 18 extending rearwardly from the front panel 12. Similarly, the lowermost rearwardly extending wall 22 and its upwardly directed lip 24 cooperatively form a pocket 35 for primary retention of those portions of the chain 18 which by gravity are disposed therein. However, upon movement of the device 10 in various spacial attitudes, the remaining portions of the panels which cooperatively form the container 34 serve to prevent the chain from moving outwardly thereof.

The first panel 12 may further include a wall extension 40 which outwardly extends from the upwardly disposed first panel wall 22 to the rear thereof and terminates in a downwardly extending flange 42. The wall extension 40 and the flange 42 thus cooperatively serve to form a convenient means whereby the display device 10 may be suspended as from a horizontally disposed bar 44 so that the normal orientation of the device is in a vertical attitude. Both the front and rear panels and those portions extending therefrom are preferably integrally formed from plastic materials such as polyethylene, polypropylene, polystyrene, etc. by low cost extrusion techniques, it being clear that the cross-sectional configurations of such interconnecting panels are specifically designed for that purpose in order to achieve a low unit construction cost for the composite display device of the present invention.

Figure 6:
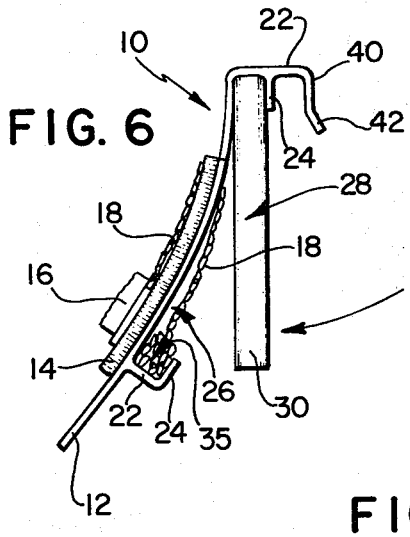
FIG. 6 is a side view of the device shown in FIG. 2 wherein the front panel thereof which in turn supports the jewelry article has been outwardly swung away from the second panel thereof.

The manner in which access may be conveniently made to the rear portion of the first panel 12 is best illustrated in FIG. 6 where it may be seen that the lower portions of the front panel 12, including the lowermost disposed wall 22 thereof, may be arcuately flexed away from the top portion thereof and consequently from those lower portions of the second panel cooperatively forming the container 34. Thereafter the second panel 28 is normally removed therefrom so as to grant full accesss to the chain 18 and the slits 20 in which such is mounted either to fully remove such from the front panel or to adjust or position such with respect thereto.

Figure 7:
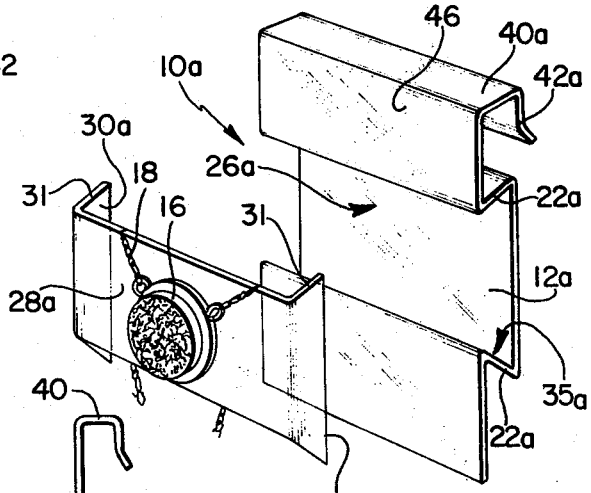
FIG. 7 is an exploded perspective view of an alternate embodiment of the device of the present invention.

Turning now to FIG. 7 of the drawing, an alternate embodiment of the present invention is shown wherein the first panel **12*a* forms a depressed portion of an overall or general panel 46 and in which the walls 22*a* thereof are upwardly inwardly directed for connection to such overall panel 46 and accordingly form an undercut channel 26*a*. Such channel is in turn adapted to receive a second panel 28*a* similar in construction to panel 28 but including flanges 30*a* having outwardly flared edge portions 31 for cooperative receipt within the undercut channel 26*a* wherein the edges 31 contact walls 22*a* and the terminal portions 33*a* of such edges 31 contact portions of the first panel 12*a* on opposite sides of the ornament 16 positioned generally centrally thereof. In this way, then, the second panel 28*a* serves to mount the jewelry in the same fashion as does panel 12 in FIGS. 1–6, while the first and second panels 12*a* and 28*a* cooperatively form a container 34*a* disposed forwardly of the first panel 12*a* and in which the excess chain 18 is adapted to be held. In such embodiment the means by which the display device 10*a* may be suspended may conveniently take the form of a wall extension 40*a* outwardly extending from the overall panel 46 and including a downwardly extending flange 42*a*. In this fashion, then, it is clear that such alternate display device 10*a*** also not only serves to display articles of jewelry but further forms a container in which the article, including excess portions of chain thereof, may be transported.

Figure 8:
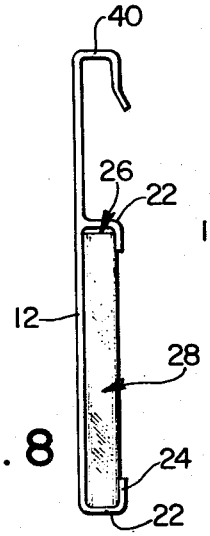
FIG. 8 is a side view similar to FIG. 6 but showing a further alternate embodiment of the present invention.
Figure 9:
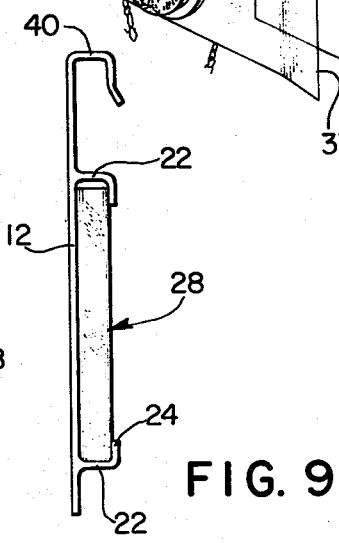
FIG. 9 is a view similar to FIG. 8 but showing still another embodiment in the present invention.

FIGS. 8 and 9 show various embodiments which the display device may take. Thus in FIG. 8 the lower wall 22 is disposed at the terminal transverse lower edge of the front panel 12 and the upper disposed wall 22 thereof positoned distal from the suspension means 40 so that the second panel 28 of the container in part formed thereby are positioned at a lower position with respect to the first panel 12 than in FIGS. 1 or 7. Similarly, the display device shown in FIG. 9 illustrates that when the upper wall 22 is disposed away from the suspension means 40, it is not necessary that the lower wall 22 outwardly extend from the lower terminal portion of the first panel 12 but may be disposed somewhat upwardly therefrom.

Although the invention, as illustrated in FIGS. 1–7, is extremely advantageous where necklaces and the like are being displayed, it will be understood that the same display package may be utilized to mount and display other articles of jewelry, such as brooches, earrings, and the like. When so used, it will be understood that the ornamental part of the brooch or earrings would still be positioned on the pad 14, and the pin of the brooch or the mounting means of the earrings will extend rearwardly through the pad 14 and panel 12 so as to be positioned within the interior of compartment 34. Suitabe openings may be provided in the pad 14 and panel 12 to permit the passage of the brooch pin or earring mounting means therethrough.

Figure 10:
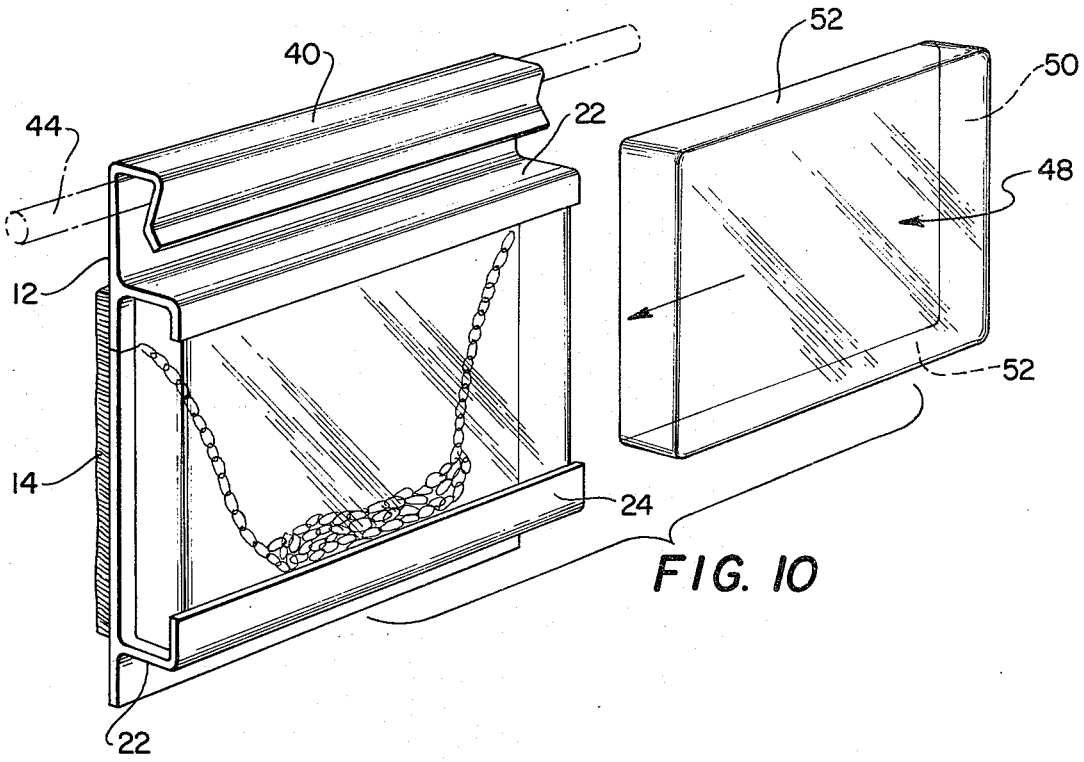
FIG. 10 is an exploded perspective view of another form of the invention.

Referring now to FIG. 10, it will be seen that the embodiment illustrated therein is identical to that illustrated in FIG. 9 with the single exception that the second panel 48, in addition to having some type of walls or flanges 50 comparable to the previously described walls 30, also has top and bottom walls 52. Thus, the second panel 48 actually has walls around its complete periphery whereas previously described second panel 28 was only provided with end walls or flanges 30. It will be understood, however, that in use and operation, the form of the invention illustrated in FIG. 10 is absolutely identical to that described in connection with FIGS. 1–6, the only difference being that when the second panel 48 is assembled to first panel 12, the flanges 22 do not actually define the top and bottom of enclosure 34, but rather the walls 52 actually do this.

Figure 11:
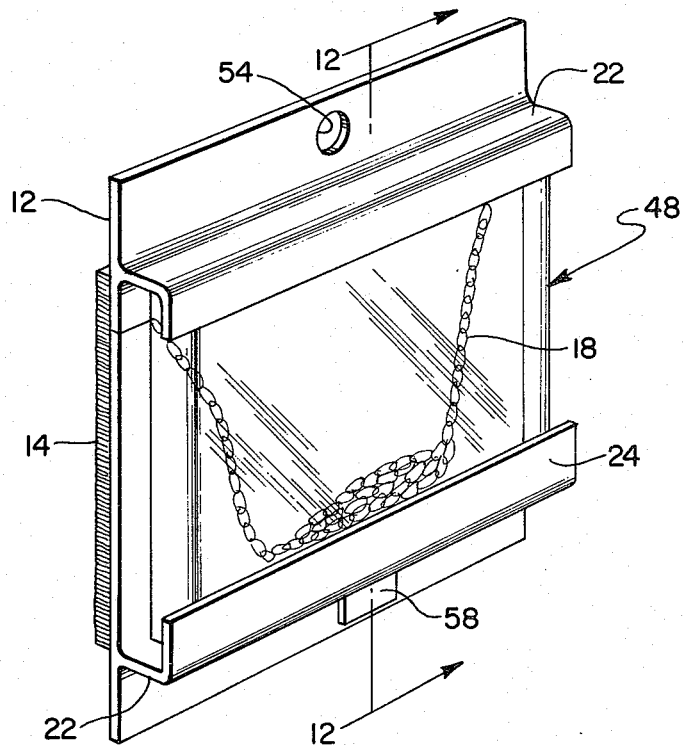
FIG. 11 is a perspective view of still another modification.
Figure 12:
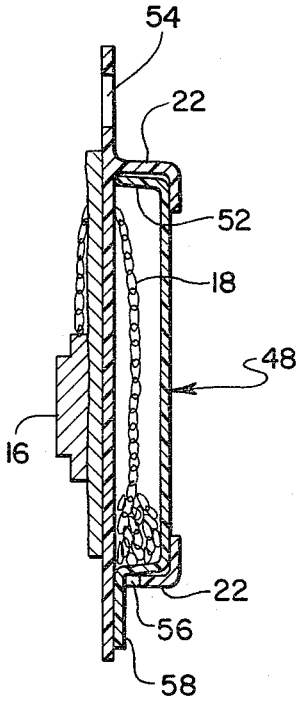
FIG. 12 is a section taken on line 12—12 of FIG. 11.
Figure 13:
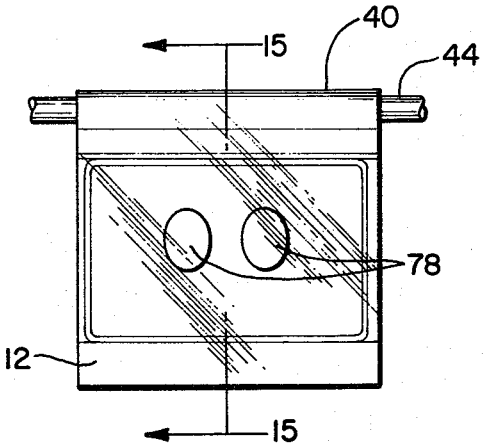
FIG. 13 is a front elevational view of another modification.
Figure 14:
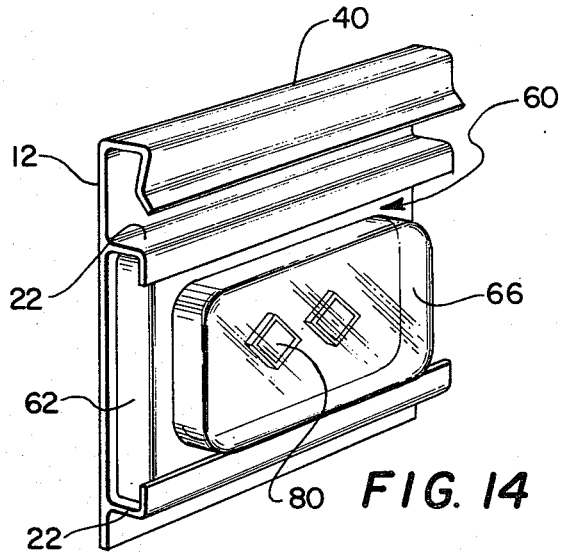
FIG. 14 is an enlarged perspective rear elevational view of the device shown in FIG. 13.

The embodiment shown in FIGS. 11 and 12 is similar to that of FIG. 10 except that the top portion of front panel 12 is provided with an opening 54 whereby the display device may be suspended from a hook or rack (not shown) as opposed to suspension from the horizontally extending bar 44. Thus, in the form illustrated in FIG. 11, the flange 40 has been eliminated. In addition, the bottom flange 22 is provided with a centrally positioned slot 56 adapted to receive a tab 58 which extends downwardly and integrally from bottom wall 52. It will be understood that the interlocking of tab 58 within slot 56 prevents undesirable sliding movement between second panel 48 and first panel 12. At the same time, the flexibility of the panels 12 and 48 permit the parts to be sufficiently flexed so that they may be disassembled from each other, as illustrated in FIG. 6, notwithstanding the interengagement of tab 58 within slot 56.

Figure 15:
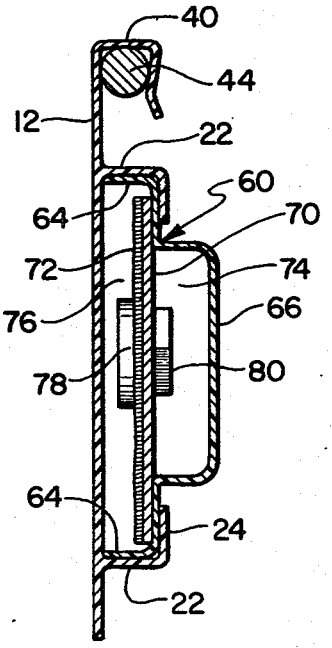
FIG. 15 is an enlarged section taken on line 15—15 of FIG. 13.
Figure 17:
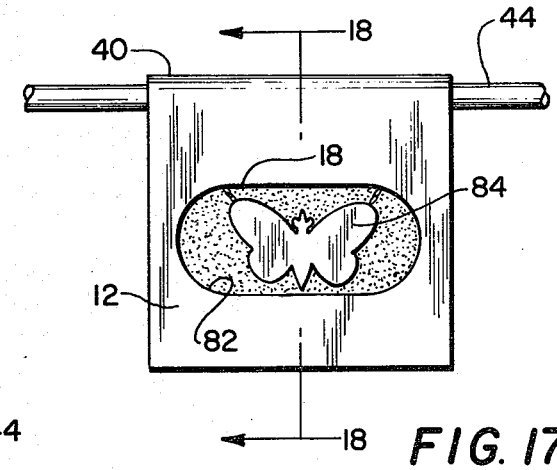
FIG. 17 is a front elevational view of still a further modification.
Figure 18:
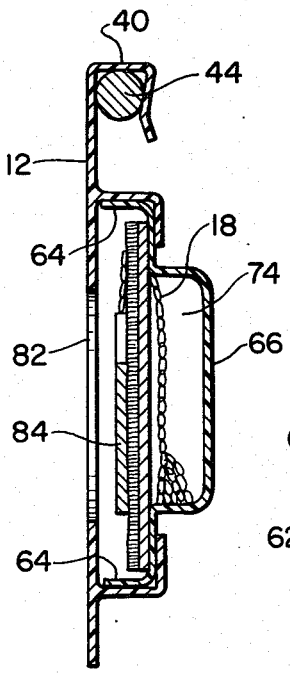
FIG. 18 is an enlarged section taken on line 18—18 of FIG. 17.
Figure 16:
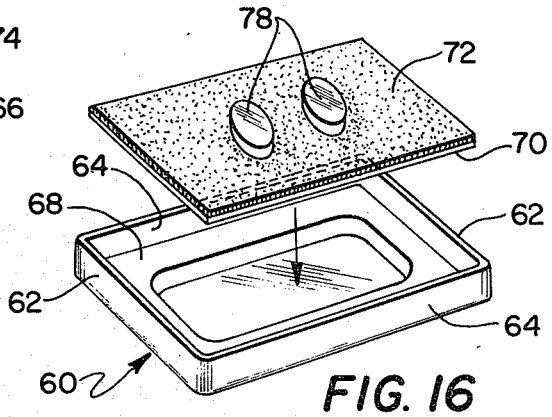
FIG. 16 is a perspective view more clearly illustrating some of the component parts of the display shown in FIGS. 13–15.

Turning now to FIGS. 13-16, a modification is shown wherein first panel 12 is once again of identical construction to the panel 12 illustrated in FIG. 9, for example. The difference in this construction resides wholly in the second panel, it being noted that the second panel 60 is once again provided with end walls 62 and top and bottom walls 64 which are received within the flanges 22 in exactly the same manner as previously described. As will be noted, the second panel 60 is provided with a centrally positioned rearwardly extending deformation or blister 66 whereby the portion of the panel 60 surrounding said deformation defines a peripheral support shoulder 68. Positioned on the support shoulder 68 is a card 70 which may be flocked or otherwise decorated on its front surface as at 72 whereby said card actually functions as a dividing wall between the interior 74 of blister 66 and the interior 76 located on the opposite side of said card. In this form of the invention, the jewelry article 78 is not mounted on the front surface of panel 12, but rather is mounted on the front surface of card 70, as illustrated most clearly in FIG. 15. This form of the invention is particularly adaptable to the display of magnetic earrings and the like, in which case the ornamental portion of the earrings 78 is positioned on the front or flocked side of the card 70, while the magnetic retaining means 80 are positioned on the rear side thereof. It will be understood that the magnetic earrings 78, 80 are maintained in position on card 70 simply by the magnetic attraction between the parts 78 and 80. Although FIG. 15 illustrates this form of the invention in connection with the display of magnetic earrings, it will be understood that any desired article of jewelry can be mounted by any suitable way on the front surface of card 70 with the pin, chain or the like extending through the card for positioning within the compartment 74. In this form of the invention, since the article of jewelry is seen by looking through panel 12, it follows that the panel 12 must obviously be of transparent material. If, however, one wishes to utilize an opaque panel 12, then an opening 82 would be provided therein in substantial alignment with the article of jewelry 84 being displayed so that the latter may be readily visible, as illustrated in FIGS. 17 and 18. It will be noted in FIGS. 17 and 18 that a necklace is being displayed, and it will be understood that the card 70 is suitably slitted so that the chain 18 may pass therethrough for positioning within the compartment 74.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for the display of jewelry articles and the like comprising a first panel having means for suspending said device in a generally vertical plane, said first panel including a front face and an opposed rear face, a pair of integral spaced parallel flanges extending rearwardly from said rear panel face and extending transversely of said panel in a side-to-side direction, a second panel received between said flanges and spaced from said rear panel face, said second panel having a pair of end walls at opposite ends thereof extending toward and contacting said first panel rear face, whereby when said second panel is in its assembled position, a complete enclosure is defined at the rear of said first panel for receiving at least a portion of the jewelry article being displayed, said second panel being removably positioned with respect to said first panel, said second panel having walls at all of its edges including said end walls, said second panel having a planar portion substantially parallel to said first panel, said substantially parallel planar portion further having a rearwardly extending deformation in part forming a portion of said enclosure which portion in turn extends rearwardly of said flanges.

2. A device for the display of jewelry articles and the like comprising a first panel having means for suspending said device in a generally vertical plane, said first panel including a front face and an opposed rear face, a pair of integral spaced parallel flanges extending rearwardly from said rear panel face and extending transversely of said panel in a side-to-side direction, a second panel received between said flanges and spaced from said rear panel face, said second panel having a pair of end walls at opposite ends thereof extending toward and contacting said first panel rear face, whereby when said second panel is in its assembled position, a complete enclosure is defined at the rear of said first panel for receiving at least a portion of the jewelry article being displayed, said second panel being removably positioned with respect to said first panel, said second panel having walls at all of its edges, said second panel further having a rearwardly extending deformation, the portion of said second panel adjacent said deformation defining a support surface, card means positioned on said support surface separating said deformation from the rest of said enclosure, means mounting an article of jewerly on the front side of said card, said deformation receiving a part of said jewelry article therein.

3. In the device of claim 2, said first panel being transparent whereby an article positioned within said enclosure is visible from the front of said device.

4. In the device of claim 2, said first panel being opaque, an opening provided in said first panel in substantial alignment with said jewelry article whereby the latter is visible through said opening.

5. A device for the display of jewelry articles and the like comprising a first panel having means for suspending said device in a generally vertical plane, said first panel including a front face and an opposed rear face, a pair of integral spaced parallel flanges extending transversely of said panel in a side-to-side direction, a second panel received between said flanges and spaced from said rear panel face, said second panel having a pair of end walls at opposite ends thereof extending toward and contacting said first panel rear face, whereby when said second panel is in its assembled position, a complete enclosure is defined at the rear of said first panel for receiving at least a portion of the jewelry article being displayed, said second panel being removably positioned with respect to said first panel, one of said flanges having a slot formed therein, said second panel having a tab interengaging within said slot, whereby sliding movement of said second panel with respect to said first panel is prevented.

6. A device for the display of jewelry articles and the like comprising, a first panel having means for suspending such device in a generally vertical position with the longitudinal extent thereof generally orientated in such vertical position, a pair of transversely extending walls longitudinally spaced from each other outwardly extending from said first panel, a second panel received between said walls and spaced from said first panel, said second panel having means for mounting an article of jewelry thereto for display thereby, said second panel having a pair of longitudinally orientated flanges outwardly extending therefrom at opposite ends thereof, said flanges adapted to contact said first panel at transversely spaced locations on opposite sides of said article so that said panels, said flanges and said walls cooperatively form a container adapted for enclosing receipt of at least portions of said jewelry article, said first panel being rearwardly offset from the adjacent panel portion, said second panel positioned on top of said first panel and generally aligned with respect to said adjacent panel portion so as to form a flush continuation thereof.

7. The display device of claim 6, said first panel walls centrally inwardly directed to form an undercut channel, said second panel flanges being centrally outwardly flared for receipt in said channel such that said second panel is transversely slidable with respect to said first panel.

8. A device for the display of jewelry articles and the like comprising a first panel having means for suspending said device in a generally vertical plane, said first panel including a front face and an opposed rear face, a pair of integral spaced parallel flanges extending rearwardly from said rear panel face and extending transversely of said panel in a side-to-side direction, a second panel received between said flanges and spaced from said rear panel face, said second panel having a pair of end walls at opposite ends thereof extending toward and contacting said first panel rear face, whereby when said second panel is in its assembled position, a complete enclosure is defined at the rear of said first panel for receiving at least a portion of the jewelry article being displayed, said second panel being removably positioned with respect to said first panel, said first panel being outwardly flexible about a transverse axis thereof so as to temporarily increase the spacing between said flanges so as to facilitate disassembly of said second panel from said first panel.

9. The display device of claim 8, wherein the upper of said flanges is connected to said first panel at the upper edge thereof, said upper flange having an extension rearwardly extending to a position past said second panel and terminating in a downwardly extending portion, said flange extension forming the means for suspending such device.

* * * * *